US006692650B2

(12) United States Patent
Park et al.

(10) Patent No.: US 6,692,650 B2
(45) Date of Patent: Feb. 17, 2004

(54) MAGNETORHEOLOGICAL FLUID AND PROCESS FOR PREPARING THE SAME

(75) Inventors: O-Ok Park, Taejon (KR); Jong-Hyeok Park, Ulsan (KR); Byung-Doo Chin, Seoul (KR)

(73) Assignee: Korea Advanced Institute of Science and Technology, Taejon (KR)

( * ) Notice: Subject to any disclaimer, the term of this patent is extended or adjusted under 35 U.S.C. 154(b) by 84 days.

(21) Appl. No.: 10/030,075

(22) PCT Filed: May 10, 2001

(86) PCT No.: PCT/KR01/00763

§ 371 (c)(1),
(2), (4) Date: Jan. 10, 2002

(87) PCT Pub. No.: WO01/86666

PCT Pub. Date: Nov. 15, 2001

(65) Prior Publication Data

US 2003/0025101 A1 Feb. 6, 2003

(30) Foreign Application Priority Data

May 10, 2000 (KR) ..... 2000-25029

(51) Int. Cl.[7] ..... H01F 1/22
(52) U.S. Cl. ..... 252/62.52; 516/22
(58) Field of Search ..... 256/62.52; 516/22

(56) References Cited

U.S. PATENT DOCUMENTS

| | | | | |
|---|---|---|---|---|
| 2,575,360 A | | 11/1951 | Rabinow | 192/21.5 |
| 2,667,237 A | | 1/1954 | Rabinow | 188/88 |
| 2,670,749 A | | 3/1954 | Germer | 137/1 |
| 2,886,151 A | | 5/1959 | Winslow | 192/21.5 |
| 3,010,471 A | | 11/1961 | Gross | 137/251 |
| 3,981,844 A | * | 9/1976 | Romankiw | 252/62.52 |
| 5,043,070 A | | 8/1991 | Hwang | 210/634 |
| 5,804,095 A | | 9/1998 | Jacobs et al. | 252/62.52 |
| 5,900,184 A | | 5/1999 | Weiss et al. | 252/62.52 |

FOREIGN PATENT DOCUMENTS

| | | |
|---|---|---|
| JP | 53-133586 | * 11/1978 |
| WO | 97/15057 | 4/1997 |

OTHER PUBLICATIONS

Park et al.; Rheological Properties and Stability of Magnetorheological Fluids Using Viscoelastic Medium and Nanoadditives; Korean J. Chem. Eng., 18(5), pp. 580–585, 2001.

Chin et al.; Rheological Properties and Dispersion Stability of Magnetorheological (MR) Suspensions; Rheol. Acta., 40, pp. 211–219, 2001.

Park et al.; Rheological Properties and Stabilization of Magnetorheological Fluids in a Water–in–Oil Emulsion; Journal of Colloid and Interface Science, 240, pp. 349–354, 2001.

Phulé et al.; Synthesis and Properties of Novel Magnetorheological Fluids Having Improved Stability and Redispersibility; Int. J. Mod. Phys. B, pp. 445–453, 1999.

* cited by examiner

*Primary Examiner*—C. Melissa Koslow
(74) *Attorney, Agent, or Firm*—Jacobson Holman PLLC

(57) ABSTRACT

The present invention provides a magnetorheological fluid in which magnetic particles coated with a hydrophilic surfactant are dispersed in a water in oil emulsion, and a process for preparing the same. The magnetorheological fluid of the present invention is prepared by adding water to oil dissolved with emulsifier, stirring it to give a mobile phase of water in oil emulsion, and dispersing magnetic particles coated with a hydrophilic surfactant in the water in oil emulsion. The invented magnetorheological fluid is improved in terms of stability through the interaction between surfactant of the magnetic particle surface and water molecule, which makes possible its practical application in the development of variable devices employing the magnetorheological fluid.

7 Claims, 3 Drawing Sheets

MAGNETORHEOLOGICAL FLUID AND PROCESS FOR PREPARING THE SAME

This is a nationalization of PCT/KR01/00763 filed May 10, 2001 and published in English.

BACKGROUND OF THE INVENTION

1. Field of the Invention

The present invention relates to a megnetorheological fluid and a process for preparing the same, more specifically, to a megnetorheological fluid in which magnetic particles are dispersed with water in oil emulsion, and a process for preparing the same.

2. Description of the Prior Art

A magnetorheological fluid, which is also called Bingham magnetic fluid, is one of intelligent materials that can reversibly control viscosity depending on the change of a magnetic field. The magnetorheological fluid is consisted of a mobile phase comprising ferromagnetic and paramagnetic particles with diameters larger than 0.1 $\mu$m and oil/water emulsion. Upon the application of a magnetic field from outside, the particles are arranged by the polarization of the inside and surface of the particles to form a fibril structure. The fibril structure plays a role to increase the viscosity and to prevent the flow of the fluid, where the yield stress increases as the strength of magnetic field increases, and the fluid comes to flow when the applied shear stress is greater than the yield stress of the fluid. The responding rate of a magnetorheological fluid to a magnetic field is as fast as $10^{-3}$ sec and reversible, which makes possible the practical application of the magnetorheological fluid in clutches, engine mounts, vibration control units, earthquake-proof equipments of the multi-storage buildings, and robotic systems.

The magnetorheological fluid is distinguished from a colloidal magnetic fluid or ferro fluid. Compared that the size of the magnetic particles of the magnetorheological fluid is generally about several to several tens of micometers, the colloidal magnetic fluid(ferro fluid) is generally known to have the particle size of 5 to 10 nm, and do not show yield stress when a magnetic field is applied. The main application area of the ferro fluid is limited to sealing and magnetic resonance systems.

To effectively apply the magnetorheological fluid to dampers and brakes of cars and trucks, the magnetorheological fluid should have high yield stress, which may be achieved by increasing the volume ratio of the magnetic particles or imposing strong magnetic fields. However, these methods are proven to be less satisfactory in the sense that the weight of the equipment and drive electricity consumption are increased when the volume ratio of the magnetic particles are increased, and the viscosity without magnetic field increases when the strong magnetic field is applied.

In this regard, several approaches have been made to develope magnetorheological fluids overcoming the defects described above and to realize their universal applications in the industry: for example, U.S. Pat. No. 2,667,237 discloses a magnetorheological fluid, in which ferromagnetic or paramagnetic particles are dispersed with a grease mobile phase of liquid, coolant, anti-oxidative gas or semi-solid state; U.S. Pat. No. 2,575,360 describes a torque transformation equipment that can be applied to clutches and brakes, together with a magnetorheological fluid in which magnetic particles (carbonyl irons) are dispersed in 50% volume fraction with a light lubricant oil that can be used in the equipment; U.S. Pat. No. 2,886,151 describes a power transferring equipment employing a fluid thin film that responds to an electric field or a magnetic field, together with a mixture of iron oxide and a lubricant grade oil with the viscosity of 2 to 20 cp as a fluid responding to the magnetic field; U.S. Pat. Nos. 2,670,749 and 3,010,471 describe the structure of a valve controlling the flow of a magnetorheological fluid including ferro, ferrite, and diamagnetic particles, where magnetic particles are dispersed with light weight hydrocarbon oils.

The magnetorheological activity of magnetorheological fluids is largely affected by the precipitation caused by gravity. One of the major causes of the precipitation is the decrease of the magnetorheological fluid stability caused by the density difference between the magnetic particle (7.86 g/cm$^3$) and the mobile phase (silicon oil=0.95 g/cm$^3$). The efforts to overcome this problem have been made, for example, U.S. Pat. No. 5,043,070 teaches the stabilization of the magnetorheological fluid by employing the magnetic particles coated with two layers of surfactants, which are proven to be unsatisfactory in light of effectiveness, and U.S. Pat. No. 5,64,752 teaches the minimization of the precipitation of magnetic particles by inducing a thixotropic network for the formation of hydrogen bonds by adding a thixotropic dopes into the magnetorheological fluid, which is failed in distinctive increase of the stability.

Therefore, there are strong reasons for developing and exploring a magnetorheological fluid with improved stability.

SUMMARY OF INVENTION

The present inventors have made an effort to provide a magnetorheological fluid with improved stability, and discovered that a magnetorheological fluid with improved stability against precipitation can be prepared by employing a mobile phase of water in oil emulsion and magnetic particles coated with hydrophilic surfactants.

A primary object of the present invention is, therefore, to provide a magnetorheological fluid including magnetic particles coated with a hydrophilic surfactant.

The other object of the invention is to provide a process for preparing the same.

BRIEF DESCRIPTION OF THE DRAWINGS

The above, the other objects and features of the invention will become apparent from the following descriptions given in conjunction with the accompanying drawings, in which.

DETAILED DESCRIPTION OF THE INVENTION

The process for preparing a magnetorheological fluid comprises the steps of: adding water to oil dissolved with emulsifier and stirring it to give a mobile phase of water in oil emulsion; mixing magnetic particles with a hydrophilic surfactant and reacting in a vacuum oven of 20 to 80° C. for 10 to 30 min, washing and drying the particles to give magnetic particles coated with the hydrophilic surfactant thereon; and, dispersing the magnetic particles in the mobile phase with 5 to 50% by volume relative to the total volume.

The process for preparing a magnetorheological fluid of the present invention is described in more detail as followings.

Step 1: Preparation of Mobile Phase

Distilled water is added to oil dissolved with emulsifier and stirred to give a mobile phase of water in oil emulsion: Span surfactant is preferably employed as the emulsifier, which is preferably dissolved in oil with 2 to 10% by weight relative to the weight of the mobile phase. The oil includes mineral oil, silicon oil, caster oil, paraffin oil, vacuum oil, corn oil, and hydrocarbon oil. The water is preferably added with 1 to 50% by volume relative to the total volume of the mobile phase, and the stirring is preferably performed at the speed of 800 to 2000 rpm for 10 to 24 hr. The mobile phase thus prepared includes the emulsion liquid-drops of water of 0.1 to 100 $\mu$m.

Step 2: Preparation of Magnetic Particles

Magnetic particles coated with a hydrophilic surfactant are obtained by mixing magnetic particles with a hydrophilic surfactant, reacting in a vacuum oven of 20 to 800° C. for 10 to 30 min, washing and drying: the magnetic particles include iron, carbonyl iron, iron alloy, iron oxide, iron nitride, iron carbide, low-carbon steel, nickel, cobalt, mixtures thereof or alloys thereof. The surfactant is preferably a hydrophilic non-ionic surfactant, more preferably non-ionic Tween (a polyoxvethvlene-substituted sorbitan fatty acid ester) surfactant, polyethylene oxide, polyalcohol, glucose, sorbitol, aminoalcohol, polyethylene glycol, amino oxide, amine salt, tetraammonium salt, pyrimidine salt, sulfonium salt, phosphonium salt, polyethylene polyamine, carboxylate, sulfonate, sulfate, phosphate, phosphonate, amino acid, betain, aminosulfate, sulfobetain or mixtures thereof.

Step 3: Preparation of Magnetorheological Fluid

The magnetic particles are dispersed in the mobile phase with 5 to 50% by volume relative to the total volume.

Figure 1A:
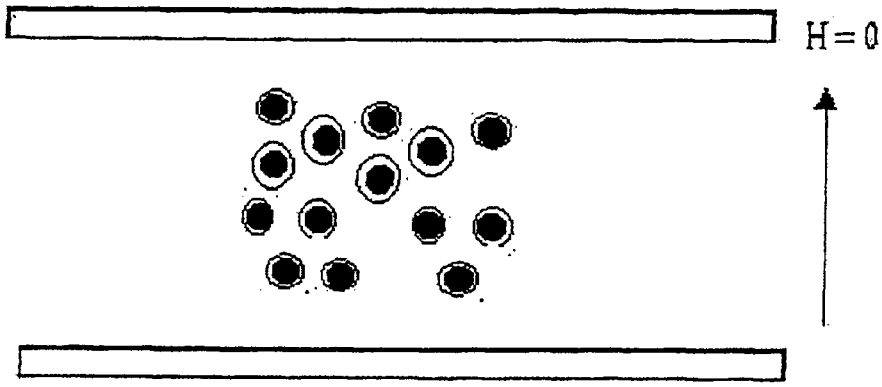
FIG. 1*a* is a schematic diagram depicting a magnetorheological fluid of the invention without applying magnetic field.
Figure 1B:
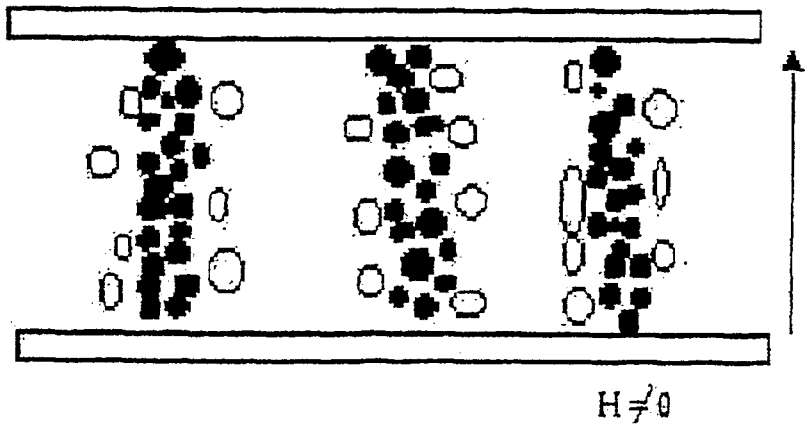
FIG. 1*b* is a schematic diagram depicting a magnetorheological fluid of the invention with applying magnetic field.

The magnetorheological fluid of the invention comprises a mobile phase of water in oil emulsion and a magnetic particles coated with a hydrophilic surfactant thereon and dispersed in the mobile phase with 5 to 50% by volume relative to the total volume. FIG. 1*a* is a schematic diagram depicting the magnetorheological fluid of the invention without applying the magnetic field. Generally, the magnetorheological fluid has the structure in which magnetic particles are gathered around water drops dispersed with the mobile phase, which are surrounded by different water layer. As shown in FIG. 1*a*, the water drops dispersed in emulsion and the magnetic particles have a similar size, making each magnetic particle be covered with water drop layer, which is assumed to be caused by the effect of the coating surfactant on the surface of magnetic particles. FIG. 1*b* is a schematic diagram depicting the magnetorheological fluid of the invention with applying the magnetic field. As shown in FIG. 1*b*, the magnetic field makes the water drop layer of the magnetorheological fluid move to be arranged along the direction of the magnetic field.

The general behavior of the magnetorheological fluid under the magnetic field is illustrated by Bingham fluid model as following:

$$\tau=\tau_y+\eta_p\gamma$$

wherein, $\tau_y$ represents a dynamic yield stress;

$\eta_p$ represents a plastic viscosity;

$\gamma$ represents a shear change rate; and, $\tau$ represents a shear stress.

The yield stress under the magnetic field increases about 1,000 to 10,000 times as compared to the yield stress without the magnetic field. The dynamic yield stress ($\tau_y$) corresponds to the shear stress at the point when the shear change rate becomes 0 on the shear stress-change rate curve, and the shear stress as low as 1 to 10 $s^{-1}$ is generally used in the experiment. The yield stress is a function of the volume ratio of the dispersion, the character of particles and mobile phase, temperature, the strength of electric field, etc.

The present invention is further illustrated by the following examples, which should not be taken to limit the scope of the invention.

EXAMPLE 1

Preparation of Magnetorheological Fluid

EXAMPLE 1-1

Preparation of Mobile Phase

Span (a sorbitan fatty acid ester) surfactant of 5% by weight relative to the mobile phase was dissolved in 50 ml of mineral acid, silicon oil, caster oil, paraffin oil, or water, and stirred at 1,500 rpm while adding 20 ml deionized water dropwise to give emulsions, and then the viscosities of the emulsions were measured at 25° C. (see: Table 1).

TABLE 1

Viscosity of emulsions containing various oil components

| Oil Component | Viscosity (Pa * s) |
|---|---|
| mineral oil | 0.02 |
| silicon oil | 0.10 |
| caster oil | 0.75 |
| paraffin oil | 4.50 |
| water | 0.01 |

Based on the results obtained as above, emulsions containing the deionized water of 0.1, 0.2, or 0.3% by volume fraction were prepared by employing mineral oil having a viscosity closest to water.

EXAMPLE 1-2

Preparation of Magnetic Particles

Carbonyl iron with a diameter of 1 to 5 $\mu$m and Tween surfactant were mixed, and chemical adsorption reaction was performed with magnetic particles in a vacuum oven of 60° C. for 1 hr. After the reaction was completed, the resultant solution was filtered, and repeatedly dispersed in distilled water and ethanol to remove any residual surfactant. And then, the particles were grinded and dried in a vacuum oven at 60° C. for 24 hr to give magnetic particles. The diameter of the magnetic particles was hardly changed compared to the diameter before the treatment.

EXAMPLE 1-3

Preparation of Magnetorheological Fluid

Figure 2:
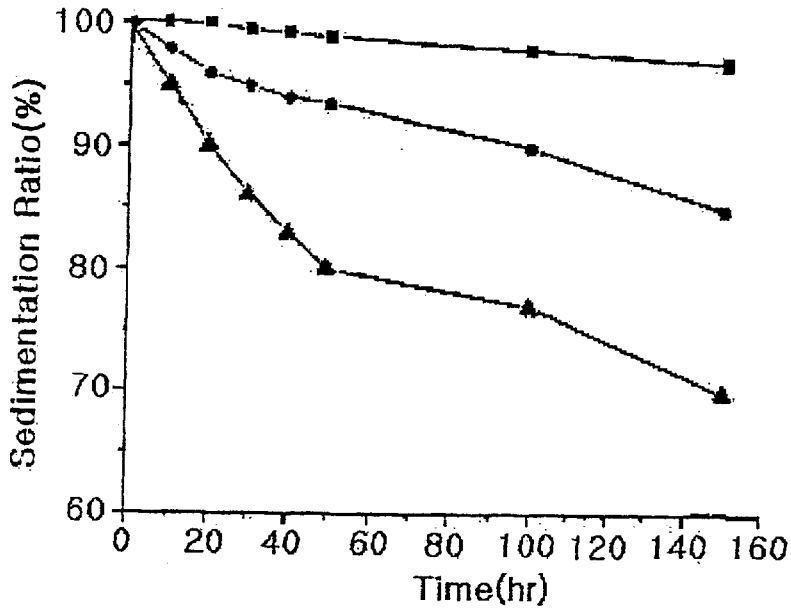
FIG. 2 is a graph showing the time-course of sedimentation ratios of magnetorheological fluids.

The magnetic particles obtained in EXAMPLE 1-2 was added with 0.4% by volume with relative to the total volume to emulsions obtained in EXAMPLE 1-1, and then dispersed to give magnetorheological fluids. The sedimentation ratio of the magnetorheological fluids depending on time was measured, respectively(see: FIG. 2). FIG. 2 is a graph showing the time-course of sedimentation ratios of magnetorheological fluids. In FIG. 2, (■) represents the sedimentation ratio of magnetorheological fluid with distilled water of 0.3% by volume, (○), magnetorheological fluid with distilled water of 0.2% by volume, and (▲), magnetorheological fluid with distilled water of 0.1% by volume, respectively. As shown in FIG. 2, the magnetorheological fluid with the highest volume of distilled water shows the greatest stability.

EXAMPLE 2

Change of Shear Stress of Magnetorheological Fluid Depending on Magnetic Field

Figure 3:
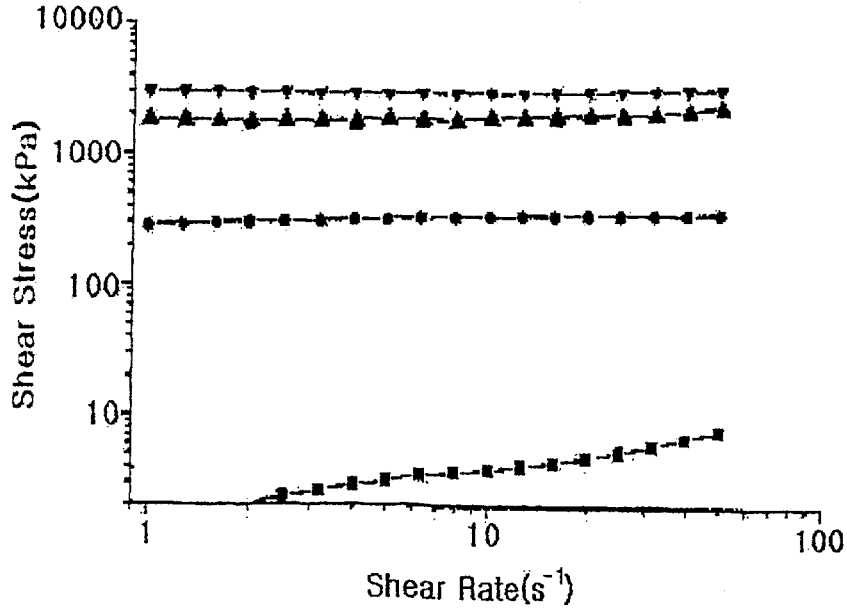
FIG. 3 is a graph showing the changes of the shear stress of a magnetorheological fluid at a specified magnetic field.

The magnetic particles obtained in EXAMPLE 1-2 was added with 0.2% by volume with relative to the total volume to the emulsion with distilled water of 0.3% by volume that showed the greatest stability in EXAMPLE 1-3, and then dispersed to give the magnetorheological fluid, whose shear stress was measured at the magnetic field of 0,0.137, 0.222, or 0.3 T by employing ARES rheometer(Rheometric Scientific Co. U.S.A.) (see: FIG. 3). FIG. 3 is a graph showing the changes of the shear stress of the magnetorheological fluid at a specified magnetic field. In FIG. 3, (▼) represents the case of the magnetic field with 0.3 T, (▲) represents the case with 0.222 T, (○) represents the case with 0.137T, and (■) represents the case with OT, respectively. As shown in FIG. 3, the magnetorheological fluid shows Newtonian behavior at a magnetic field of 0T, and shows Bingham behavior as the magnetic field was applied. The shear stress increased as the strength of the magnetic field increased.

EXAMPLE 3

Figure 4:
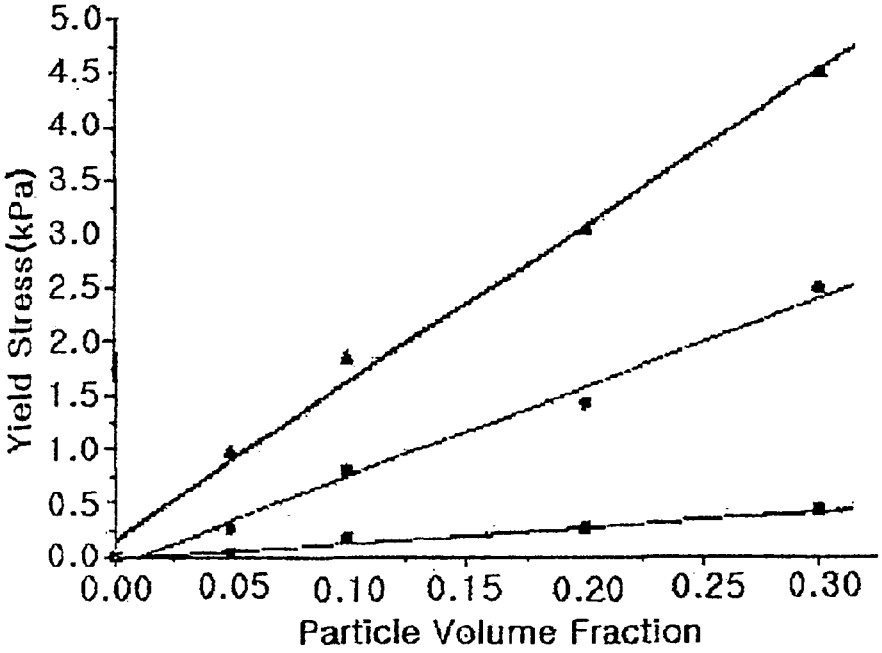
FIG. 4 is a graph showing the changes of yield stress of a magnetorheological fluid depending on the particle volume fraction of magnetic particles at a specified magnetic field.

Change of Yield Stress of Magnetorheological Fluid Depending on Volume Ratio of Magnetic Particles The magnetic particles obtained in EXAMPLE 1-2 was added with 0.05, 0.1, 0.2, or 0.3% by volume relative to the total volume to the emulsion with distilled water of 0.3% by volume that showed greatest stability in Example 1-3, and then dispersed to give the magnetorheological fluid, whose yield stress was measured at the magnetic field of 0.095, 0.18, or 0.3 T by employing ARES rheometer(see: FIG. 4). FIG. 4 is a graph showing the changes of yield stress of the magnetorheological fluid depending on the particle volume fraction of magnetic particles at a specified magnetic field. In FIG. 4, (▲) represents the case of the magnetic field with 0.3 T, (○) represents the case with 0.18 T, and (■) represents the case with 0.095 T, respectively. As shown in FIG. 4, yield stress increased as the strength of magnetic field increased in proportion to the volume of the magnetic particles regardless of the strength of magnetic field.

As clearly described and demonstrated as above, the present invention provides a magnetorheological fluid in which magnetic particles coated with a hydrophilic surfactant are dispersed in a water in oil emulsion, and a process for preparing the same. The magnetorheological fluid of the present invention is prepared by adding water to oil dissolved with emulsifier, stirring it to give a mobile phase of water in oil emulsion, and dispersing magnetic particles coated with a hydrophilic surfactant in the water in oil emulsion. The invented magnetorheological fluid is improved in terms of stability through the interaction between surfactant of the magnetic particle surface and water molecule, which makes possible its practical application in the development of variable devices employing the magnetorheological fluid.

Although the preferred embodiments of present invention have been disclosed for illustrative purpose, those who are skilled in the art will appreciate that various modifications, additions, and substitutions are possible, without departing from the spirit and scope of the invention as disclosed in the accompanying claims.

What is claimed is:

1. A process for preparing a magnetorheological fluid which comprises the steps of:

(i) adding water to oil dissolved with emulsifier and stirring it to give a mobile phase of water in oil emulsion;

(ii) mixing magnetic particles with a hydrophilic surfactant and reacting in a vacuum oven of 20 to 80° C. for 10 to 30 min, washing and drying the particles to give magnetic particles coated with the hydrophilic surfactant thereon; and, (iii) dispersing the magnetic particles in the mobile phase with 5 to 50% by volume relative to the total volume.

2. The process for preparing a magnetorheological fluid of claim 1, wherein the emulsifier is a sorbitan fatty acid ester surfactant which is dissolved in oil with 2 to 10% by weight relative to the weight of the mobile phase.

3. The process for preparing a magnetorheological fluid of claim 1, wherein the oil is selected from the group consisting of mineral oil, silicon oil, caster oil, paraffin oil, vacuum oil, corn oil and hydrocarbon oil.

4. The process for preparing a magnetorheological fluid of claim 1, wherein the distilled water is added with 1 to 50% by volume relative to the total volume of the mobile phase.

5. The process for preparing a magnetorheological fluid of claim 1, wherein the magnetic particles are selected from the group consisting of iron, carbonyl iron, iron alloy, iron oxide, iron nitride, iron carbide, low-carbon steel, nickel, cobalt, mixtures thereof and alloys thereof.

6. The process for preparing a magnetorheological fluid of claim 1, wherein the hydrophilic surfactant is a member selected from the group consisting of an oxidized ethylene-substituted sorbitan fatty acid ester surfactant, polyethylene oxide, polyalcohol, glucose, sorbitol, aminoalcohol, polyethylene glycol, amino oxide, amine salt, tetraammonium salt, pyrimidine salt, sulfonium salt, phosphonium salt, polyethylene polyamine, carboxylate, sulfonate, sulfate, phosphate, phosphonate, amino acid, betain, aminosulfate, sulfobetain and mixtures thereof.

7. A magnetorheological fluid prepared by the process of claim 1, which comprises a mobile phase of water in oil emulsion and magnetic particles coated with a hydrophilic surfactant thereon and dispersed in the mobile phase with 5 to 50% by volume relative to the total volume.

* * * * *